United States Patent [19]

Mitter

[11] 3,995,551

[45] Dec. 7, 1976

[54] WEB TENSIONING AND FEEDING APPARATUS

[75] Inventor: Mathias Mitter, Verl-Sende-Mitte, Germany

[73] Assignee: Mitter & Co., Schloss Holte, Germany

[22] Filed: June 27, 1974

[21] Appl. No.: 483,698

[30] Foreign Application Priority Data

June 28, 1973 Germany ..... 2332864
Jan. 8, 1974 Germany ..... 2400729

[52] U.S. Cl. ..... 101/118; 101/181; 101/228; 101/DIG. 21; 226/195

[51] Int. Cl.[2] ..... B41F 15/24; B41F 13/02

[58] Field of Search ..... 226/44, 195, 170, 193; 101/118, 228, 181, 115, DIG. 21, 116, 126; 26/51, 54; 118/33, 46; 242/75, 75.2, 75.4

[56] References Cited

UNITED STATES PATENTS

| | | | |
|---|---|---|---|
| 932,600 | 8/1909 | Burdick | 101/115 |
| 2,237,179 | 4/1941 | Gromm | 101/116 |
| 2,745,134 | 5/1956 | Collins | 226/44 X |
| 2,809,582 | 10/1957 | Crawford | 101/181 |
| 3,087,663 | 4/1963 | Anderson | 226/44 |
| 3,420,167 | 1/1969 | Winden | 101/116 |
| 3,755,861 | 9/1973 | Castro et al. | 26/54 |
| 3,811,378 | 5/1974 | Bohm | 101/116 X |
| 3,854,672 | 12/1974 | Tilban | 226/195 |
| 3,889,595 | 6/1975 | Jaffa | 101/118 X |

*Primary Examiner*—Clifford D. Crowder
*Assistant Examiner*—R. E. Suter
*Attorney, Agent, or Firm*—Michael J. Striker

[57] ABSTRACT

A web is guided onto a movable support, such as a printing blanket, and the web and the support are advanced together in a common direction, but at differential speeds so that the web will be subjected to tensioning. Onto the thus supported and tensioned web, a print is then applied. The invention discloses an apparatus for carrying out the above sequence.

25 Claims, 17 Drawing Figures

6
60
96
96'
95
95'
92
92'
94
94'
62
61
99
90
82
85
81a
81
93
83
97
98
91
9
84
81b 40
140
493
393'
393''
393
52
199
191
192'
193
19
82
81a
81b
293
190
192
81
297
197
198

6
96'
95'
94'
G
D
60
SP
96
95
94
81
82
9
99
97
297
1
5
61

WEB TENSIONING AND FEEDING APPARATUS

BACKGROUND OF THE INVENTION

The present invention relates generally to the printing of webs, and more particularly to the printing of traveling webs. Still more particularly, the invention relates to an apparatus for printing a traveling web.

It is known to print traveling webs in printing machines, usually of the screen printing type. Especially if the web is a textile web, and if a screen printing machine is used, it is customary to apply the web onto a traveling printing blanket of the machine, which serves to support the web. Usually, the web is adhesively secured (by means of adhesive which allows it later to be stripped off) to the printing blanket, or else the printing blanket is provided with needle projections which penetrate into the web (this is usually done when the web is of a heavy quality, for instance a carpet). The purpose is to assure an absolute uniformity of the movements of the web and the printing blanket; in other words: no relative displacement of printing blanket and web is to be allowed to occur.

Theoretically, this approach works well. In actual fact, however, difficulties are frequently experienced, especially if the web is of a relatively heavy character, for instance carpeting or the like. Heavier textile webs, such as carpets, cannot be so produced that they are absolutely uniform in tension over their entire width. As a general rule, the edge portions of such a web are woven more loosely than the center portions, or sometimes the reverse might be true. In any case, it is well known that if a web which has this differential characteristic is advanced in the manner outlined above through a screen printing machine, bulges will frequently form in the web when it passes beneath the printing screens, with the result that the image or pattern that is being printed onto the web will become blurred and unsightly. The reason for this is that the web will be locally squeezed as it passes under the printing screen and an unsightly print will be obtained, or a local relative displacement will occur between portions of the web that are displaced by contact with the printing screen, and the printing screen and printing blanket.

SUMMARY OF THE INVENTION

Accordingly, it is an object of the invention to overcome these disadvantages of the prior art.

More particularly, it is an object of the present invention to provide an improved apparatus for printing a traveling web which is not possessed of the aforementioned disadvantages.

Another object of the invention is to provide such an improved apparatus in which tension differentials within the web to be printed are compensated, thus assuring that the print that is applied to the web is not blurred or otherwise of undesirable characteristics.

In keeping with the aforementioned objects, and with others which will become apparent hereafter, one feature of the invention resides in an apparatus for printing a traveling web which, briefly stated, comprises means for guiding a web onto a movable support, means for advancing the web and the support together in a common direction but at differential speeds, and means for printing onto the thus supported web.

The web is supplied onto the movable support, such as a printing blanket, in an already tensioned state so that its internal stresses or tensions are already equalized. This equalization is maintained due to the fact that the differential speeds of advancement of the web and the support, of which the latter travels at a slightly faster rate of speed than the web, maintains a tension upon the web which is uniform over the entire width of the web due to the frictional engagement of web and support, and the slight slippage resulting from the speed differential.

A further important concept of the invention provides for the printing to take place wholly or partially in relative movement with reference to the direction of advancement of the web itself. In other words, it is desired to obtain a certain amount of slip between the surface of the web onto which the print is applied, and the printing screen which effects the printing. The printing screen may be operated at a speed which is fast or slow with respect to the advancement of the web, since in either case a further tension will be exerted upon the web and a further equalization of tensions in the web will be obtained. The desired slip must, of course, be small and can be on the order of approximately 1 or 2 percent, so that it will not be sufficient to cause a noticeable distortion in the applied print. On the other hand, the ability of providing such slip makes it possible, assuming that several screen printing units are provided which all print upon the web one behind the other, and assuming that they can be independently controlled as to their speed of operation, to obtain shifts in the pattern of the print that is being applied to the web.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
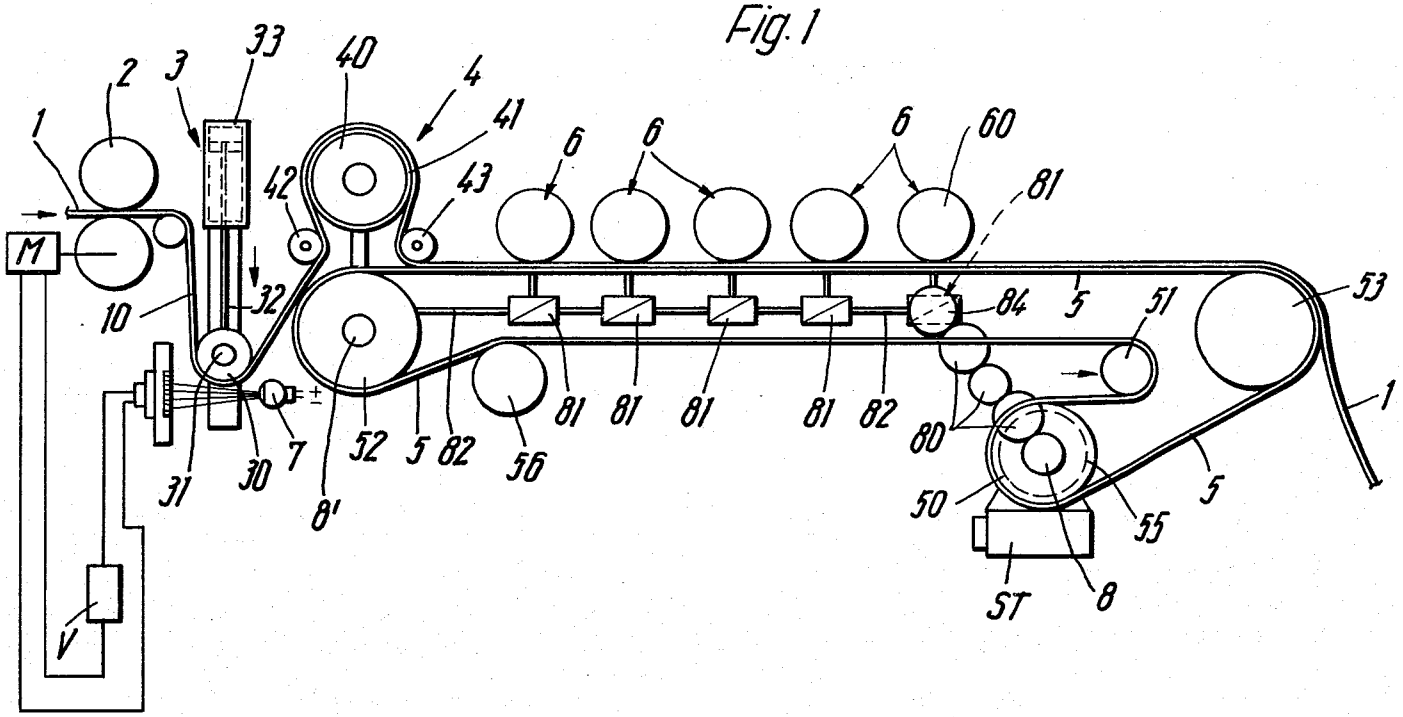
FIG. 1 is a diagrammatic side view illustrating one embodiment of an apparatus according to the invention.
Figure 1A:
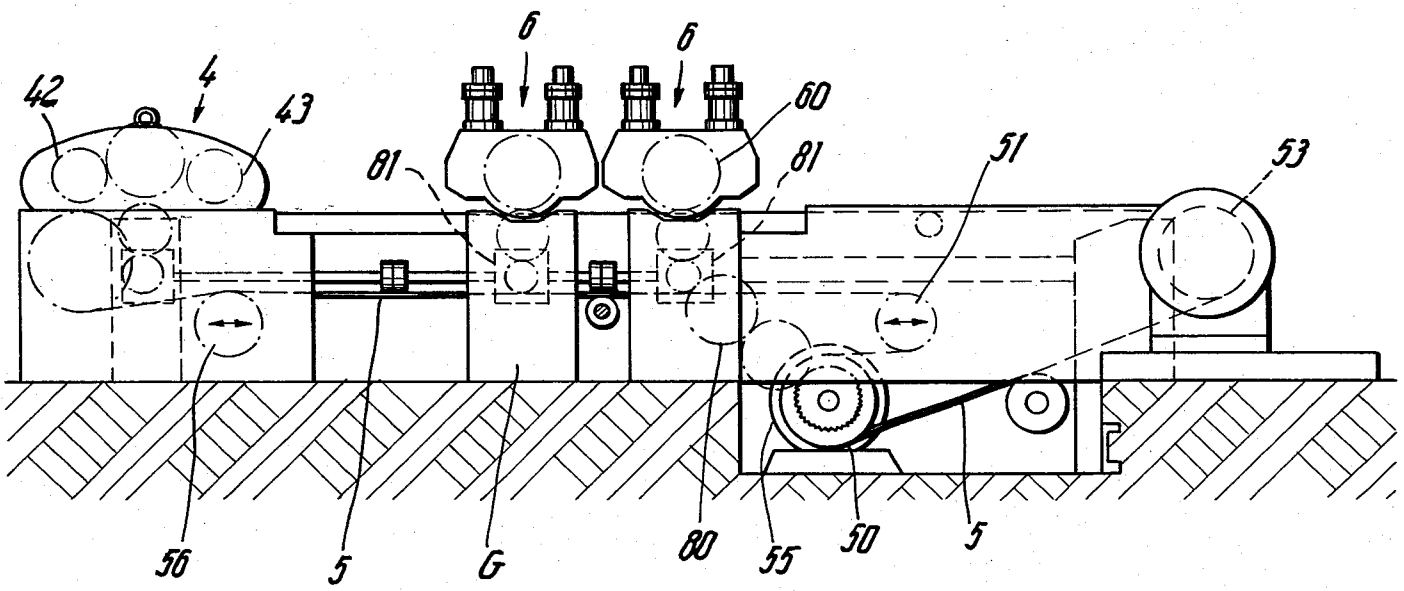
FIG. 1*a* is a more structural overall side view showing the machine of FIG. 1.

Referring to the drawing in detail, and firstly to FIGS. 1, 1*a* and also 5, it will be seen that a web 1 which is to be printed, for example a strip of carpet which may have a width on the order of 15 feet, passes between the nip of a pair of cooperating nip rollers 2 in the direction indicated by the arrow, and then forms a loop 10 which is tensioned by a tensioning device 3. From the tensioning device 3 the carpet 1 then travels to the feeding device 4 which feeds it by cooperation of its feed roller 40 with the guide rollers 42 and 43 which constitutes guide means for the web onto the upwardly directed side of a traveling printing blanket 5 which travels towards the right in FIG. 1 about the rollers 50, 51, 52 and 53. On the printing blanket 5 the carpet 1 travels beneath a plurality of printing units 6 which are diagrammatically illustrated in FIG. 1, and more structurally in FIG. 1*a*, and which for purposes of this specification will be discussed as being rotary-screen printing units each having a squeegee roller located within the respective tubular printing screen. However, it should be understood that non-tubular printing screens could also be used, and in fact the application might also be employed with printing units which do not operate on the screen printing principle.

Figure 4:
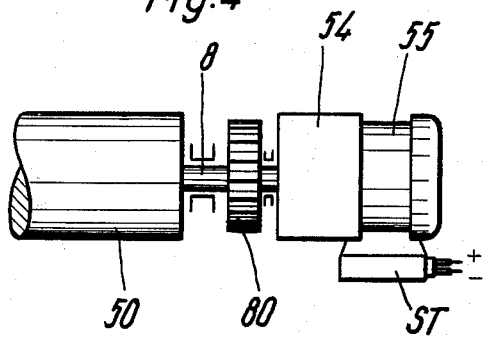
FIG. 4 is a fragmentary detail view illustrating an embodiment of a main machine drive for the machine in FIG. 1.

The roller 51 is a tension roller with is spring biased towards the right in FIG. 1, as indicated by its associated arrow, and which serves to maintain the printing blanket 5 in tensioned condition. The tension of the printing blanket 5 can be further regulated by the roller 56 which is not spring biased but is so mounted that it can be moved with reference to the printing blanket 5, in a sense causing the latter to become more or less tensioned; i.e., the roller 56 in FIG. 1 is mounted so that it can be moved up or down to thereby tension or relax the printing blanket 5. The rollers 52 and 53 serve as reserving rollers for the printing blanket 5, and the drive of the latter could be obtained by making one or the other of these two rollers a driven roller. In the illustrated embodiment, however, it is the roller 50 which is driven and thereby advances the printing blanket 5. FIG. 4 shows that the drive can be imparted to the roller 50 via the main shaft 8, 8*a* which, in turn, is driven from an electric motor 55 that is controlled by a motor control unit ST, via an interposed continuously variable transmission 54. Reference numeral 80 in FIG. 4 identifies an output drive by means of which motion is transmitted also from the shaft 8 to the drives for the printing screens of the units 6.

To carry out the method of the present invention, the web 1--e.g., a strip of carpet--travels between the nip of the nip rollers 2 which tightly engage it during such travel, and forms downstream of these nip rollers 2 the loop 10. In order to tension the carpet 1, the tensioning device 3 is provided having a roller 30 which engages in the loop and which is mounted for rotation about a shaft 31 on the piston rod 32 of a fluid pressure operated cylinder 33 that is suitably mounted on the frame of the machine. When fluid is admitted into the cylinder 33, the piston thereof will move downwardly and urge the roller 30 against the carpet 1 within the loop 10. Since from the loop 10 the carpet 1 passes around a feed roller 40 of the feeding device 4, which it surrounds over a substantial portion of its periphery due to the location of the guide rollers 42, 43 under which it must pass, the operation of the tensioning device 3 tensions the carpet 1 intermediate the nip of the rollers 2 and the device 4. A photoelectric arrangement 7 may be provided to control the length of the loop 10, and may be connected as illustrated via an amplifier V with a motor control unit M of a drive for rollers 2 to regulate the speed of the carpet 1 and to thereby maintain the loop 10 of substantially uniform size, in that deviations from this size are detected by the photoelectric detector 7 and cause variations in the feeding speed until the loop 10 is restored to its original intended size.

The feeding device 4 has the aforementioned feeding roller 40 which preferably is provided on its circumference with a high-friction layer 41, for instance a layer of natural or synthetic rubber which prevents relative slippage between the roller 40 and the carpet 1. The rollers 42, 43 are mounted so as to extend in axial parallelism with the axis of the roller 40, and by being so located that the carpet 1 must loop around a large portion of the periphery of the roller 40 they serve to further prevent slippage between the latter and the carpet 1.

From the roller 43, the carpet 1 moves onto the upper surface of the upper run of the printing blanket 5. According to the present invention the speed at which the carpet 1 and the printing blanket 5 advance while they are in contact is to be differential, and in fact the speed of advancement of the printing blanket 5 is to be somewhat greater than part of the carpet 1. This speed differential is obtained by driving the roller 50 and the roller 40 at different angular speeds, in that the roller 40 rotates slightly more slowly than the roller 50. The speed differential can be quite small and can be readily determined empirically by those conversant with this art. The only requirement is that a slight tension develop in the carpet 1 due to the frictional engagement between the same and the printing blanket 5, and the tendency of the printing blanket 5 to overrun the carpet 1. The thus developing tension is sufficient to maintain the equalization of the differential tensions originally existing in the carpet 1 over the width thereof, which was obtained by the device 3, or even to aid in obtaining this equilization.

Figure 5:
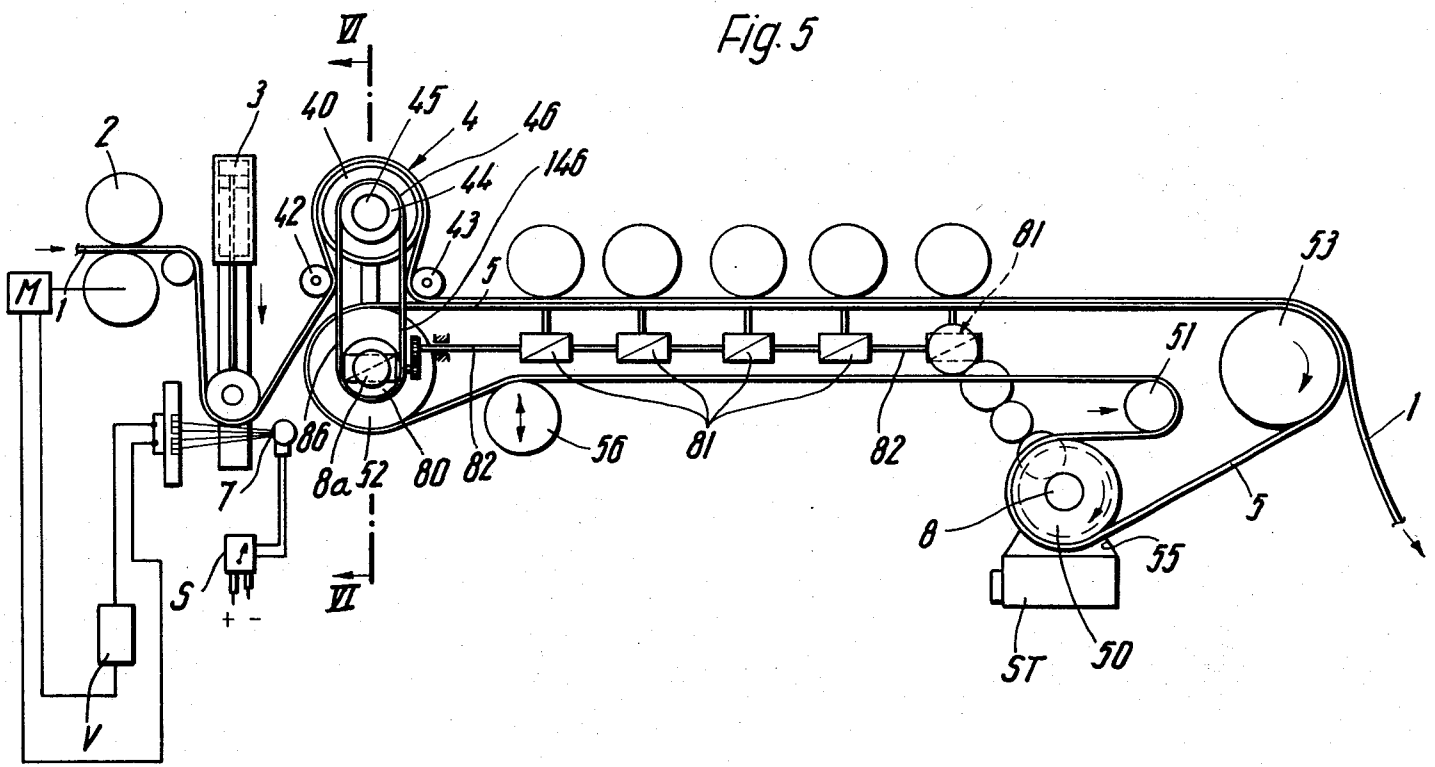
FIG. 5 is a view analogous to FIG. 1, but illustrating a somewhat different embodiment of the machine.

As the carpet 1 travels with the printing blanket 5 in clockwise direction in FIGS. 1, 1a and 5, it passes beneath the printing units 6 which, as pointed out earlier, are here illustrated as having tubular printing screens, although other printing devices, including non-tubular printing screens, could also be employed. Similarly, the number of printing units 6 could differ from the number that has been illustrated for purposes of example.

The shaft 8, 8*a* shown for instance in FIGS. 1 and 4, is intended to symbolically represent the main drive of the machine. It is provided with the aforementioned output drive 80 which transmits motion to angle drives 81 of the respective printing units 6. Two of these units with their drives have been illustrated diagrammatically in FIG. 2, and it will be appreciated from a comparison with FIG. 1 that the angle drives of the several units are all, in turn, connected for joint operation by a shaft 82. Structural details of this arrangement are shown more clearly in FIG. 12. Reference to these Figures will show that the shaft 82, which can also extend to the drive for the roller 40, as will be discussed later, drives the angle drives 81 of the several printing units 6. Each of the angle drives has an input gear 81a and an output gear 81*b*. The shaft 83 of the output gear 81b carries a gear 84 and is connected via a further gear 85 with a planetary gear drive 9. The latter has a main shaft 90 which carries the gear 85 and is thereby connected with the angle drive 81, also drives a gear 91 which then rotates a planetary gear carrier 92. The latter engages with gear ring 93 which is mounted on the shaft 90 so as to freely turn about the same. The gear ring 93 meshes with an intermediate gear 94 which transmits motion to gears 95 and 96 which then drive the tubular printing screen 60 of the respective printing unit 6. They can also drive the squeegee roller 61 which is located in the interior of the tubular printing screen 60. For this purpose, the shaft 62 drives via the gears 95' and 96', and an intermediate gear 94, the squeegee roller 61 in rotation, and the arrangement obtains a uniform relative rotation of the printing screen 60 and the squeegee roller 61.

Figure 2:
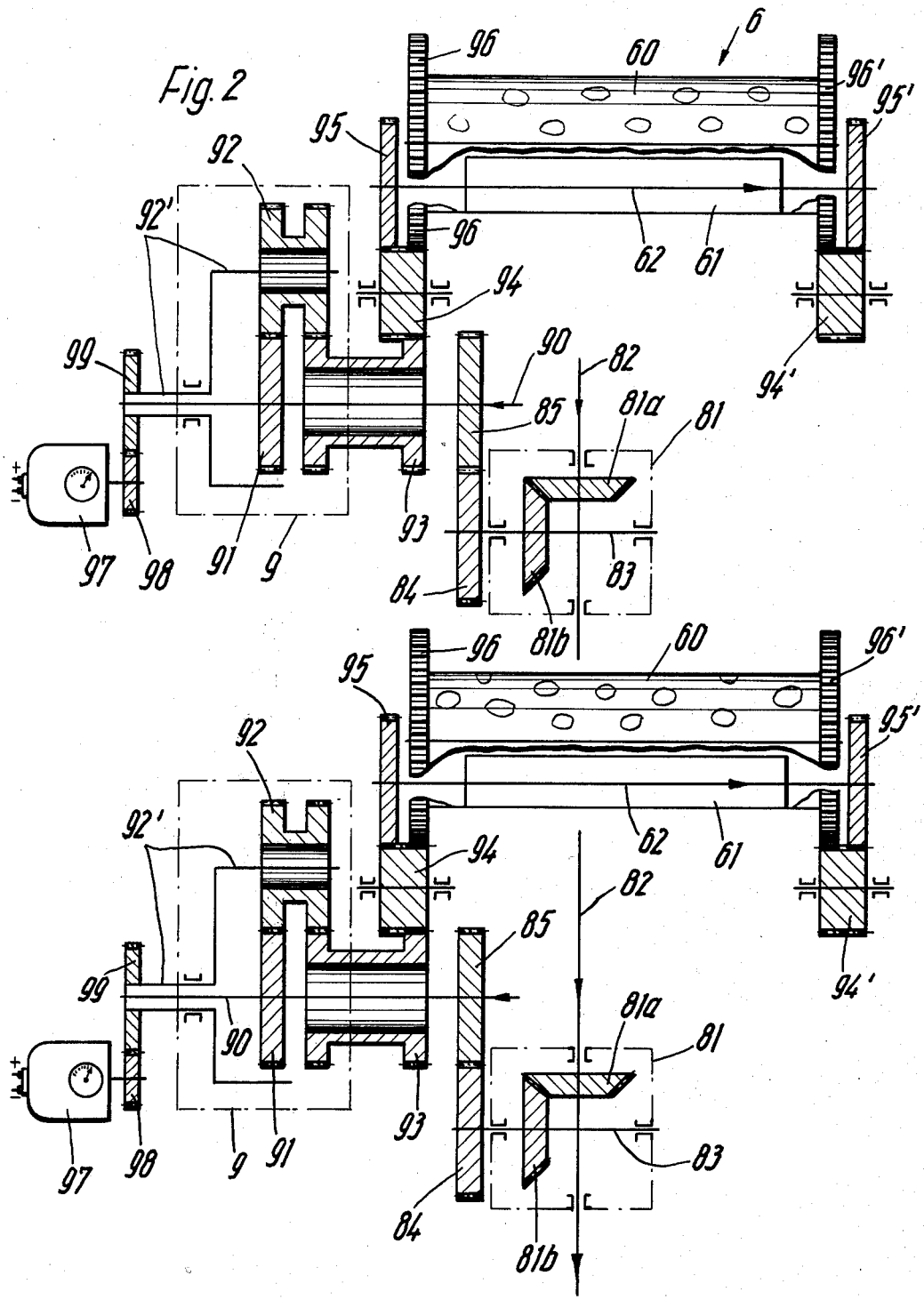
FIG. 2 is a diagrammatic sectional view illustrating details of a drive arrangement for driving the printing screens of the screen printing units of the machine in FIG. 1.

To operate the planetary gear drive 9 and make it effective when desired, a control motor 97 is provided which turns the gears 98 and 99 and thus rotates the shaft 92' of the planetary gear carrier 92 which loosely rotates about the shaft 92'. When the control motor 97 is not energized, there is a simple gear transmission via the angle drives 91 to the several printing screens 60 of the respective printing units 6. In other words, all of the printing screens 60 operate at one and the same circumferential speed. When the motor 97 is energized, the planetary gear drive 9 of the respective printing unit 6 is operated and, depending upon whether the motor 97 is used for speeding up or retarding the rotation of the respective printing screen 60, the circumferential speeds of the printing screens 60 of the several units 6 can be adjusted as desired with reference to one another. FIG. 2 shows clearly that the drive arrangement can be identical for all of the printing units 6, as suggested by the two printing units that are illustrated in that Figure.

Figure 3:
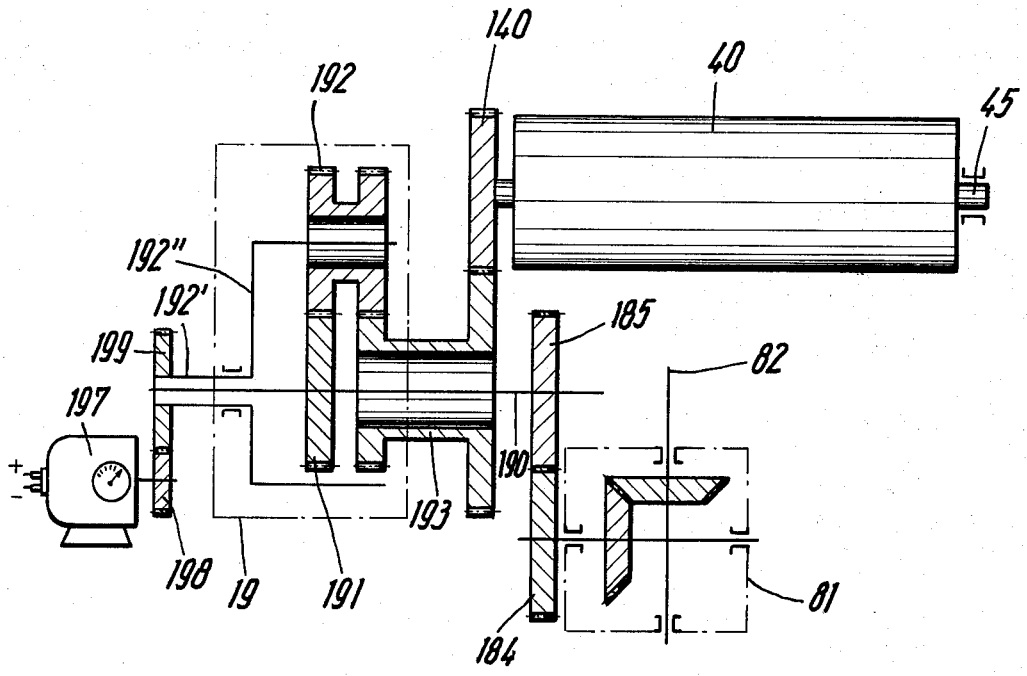
FIG. 3 is a partly sectioned detail view illustrating an embodiment of a drive for the feeding roller which feeds the web in the machine of FIG. 1.
Figure 8:
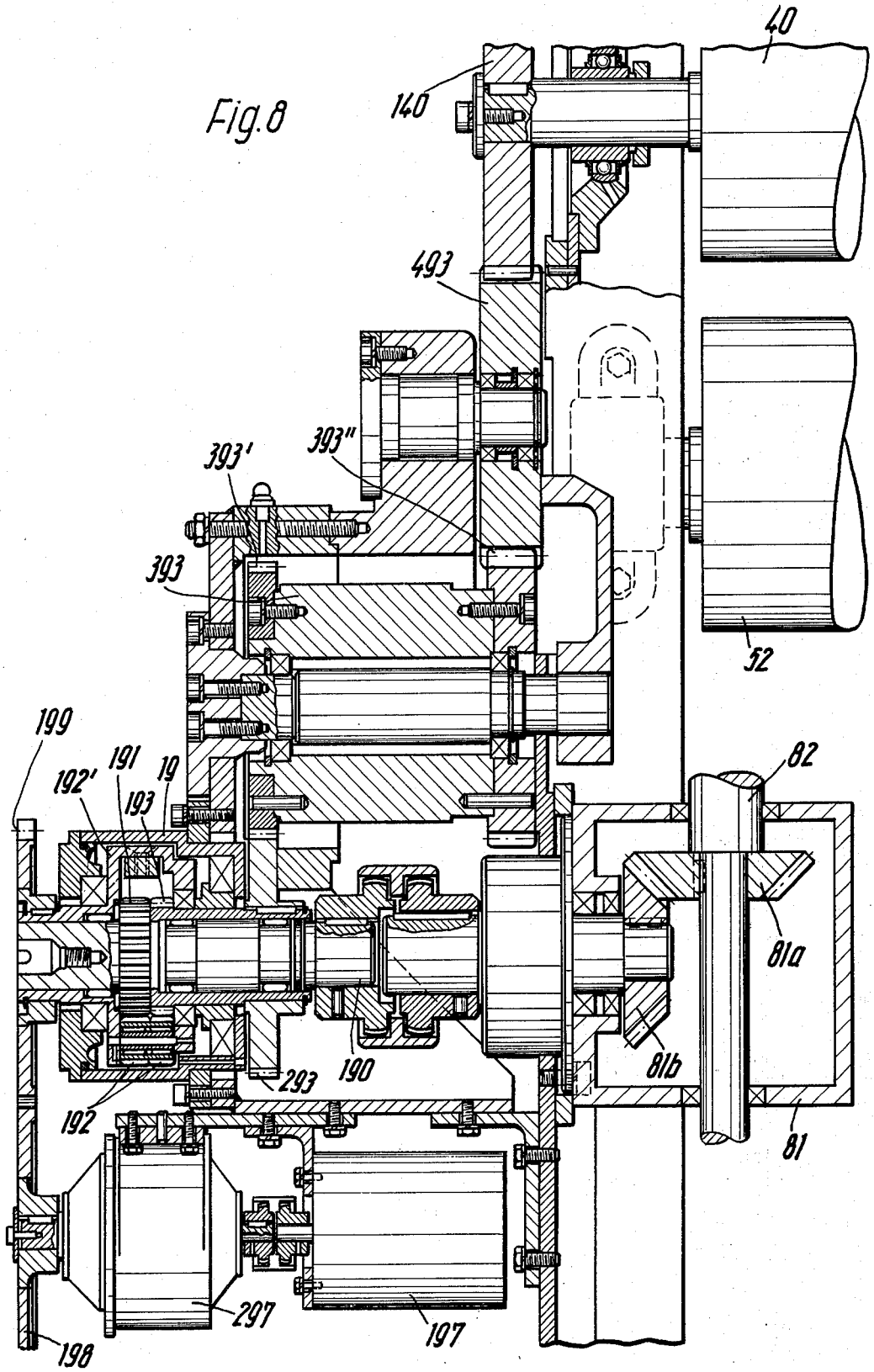
FIG. 8 is a sectioned view showing the structural details of the arrangement that is diagrammatically shown in FIG. 3.

The rotational speed of the rotor 40 can be similarly regulated, and the drive for it can also be of the same type as that employed for the printing units 6. This is illustrated in FIGS. 3 and 8, where another angle drive 81, also driven by the shaft 82, will be seen to act upon and turn the gears 184 and 185. The gear 185 has a shaft 190 which turns a gear 191 that drives the planetary gear carrier 192 of a planetary gear drive 19. The carrier 192 engages with gear ring 193 which, in turn, can act directly upon a gear 140 of the roller 40, to rotate the shaft 45 of the latter. A control 197 is provided for this drive also, and the output shaft thereof turns the gear 198 which meshes with a gear 199 that is mounted on the shaft 192' of the planetary gear carrier 192 and turns the latter via the branch shaft 192''. When it is desired that there be a speed differential between the speed of advancement of the carpet 1 and that of the printing blanket 5, the motor 197 is operated to retard the speed of rotation of the roller 40 with respect to that of the roller 50.

It would, of course, also be possible to provide a completely separate drive for the roller 40, that is a drive which is not powered from the shaft 8. The principle of operation would, however, remain the same.

In any case, by resorting to the present invention and obtaining the desired differential speeds of advancement of the carpet 1 and the printing blanket 5, a largely or completely uniform tension over the entire width of the carpet 1 is obtained, even though the latter be of a width on the order of 15 feet and be in the process of being printed over this entire width. When the type of web that is to be printed does not present the particular problems with which the present invention is intended to cope, for example if it is a textile of light weight, then it will be appreciated that the construction herein disclosed makes it possible to have the web 1 and the printing blanket 5 advance at identical speeds, so that there is no relative displacement between them, and also to have no relative speed differential between the web 1 and the printing screens 60. If, however, a web is to be printed which presents the problems that have been outlined at the beginning of this specification, then the desired speed differentials can be readily obtained. Also, speed differentials between the web 1 and the printing screens 60 can be selected at will, in order to obtain different printed patterns, to shrink the patterns or expand them, and for similar purposes. It will be appreciated that the degree of precision of the pattern print will be much greater if there is no speed differential between the web 1 and the printing screens 60.

Figure 6:
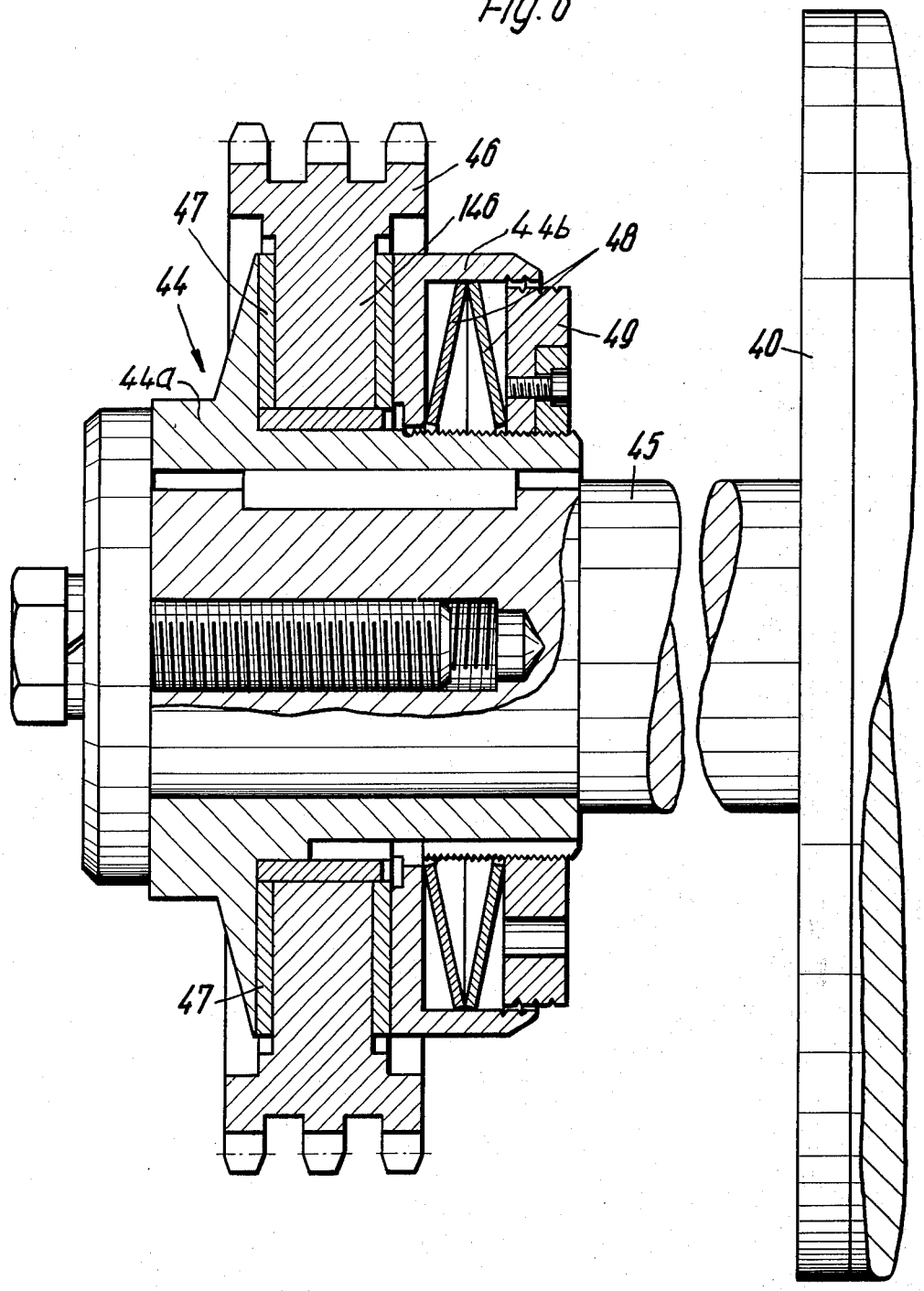
FIG. 6 is a fragmentary enlarged axially sectioned view in a section taken on line VI—VI of FIG. 5, illustrating a slip coupling used in the embodiment of FIG. 5.

To provide for an automatic adjustment of the arrangement to the tension conditions and conditions of relative movement between carpet 1 and printing blanket 5 that exist at any given time, it is highly advantageous to provide, according to a further concept of the invention, an adjustable slip coupling 44 as part of the drive for the roller 40. FIG. 6 shows that the slip coupling 44 can be mounted on the shaft 45 of the roller 40, whereas FIG. 7 shows that it can also be mounted in the region of the shaft 82, and more particularly in the region of the angle drive 81 which is driven by the shaft 82 and, in turn, drives the roller 40.

The embodiment in FIG. 6 is the simpler of the two. It will be seen that in this embodiment, which is incorporated in the machine of FIG. 5, the slip coupling 44 has an annulus 46 of gear teeth, a portion 146 of which is clampingly retained in a groove formed between friction pads 47 which are respectively carried on the components 44*a*, 44*b*, of the slip coupling 44. The friction pads 47 are maintained in frictional engagement with the portion 146 by the dished or Belleville springs 48 of which any desired number can be provided, and which can be arranged in various ways, for instance only in the manner shown in FIG. 6 but also in that shown in FIG. 7. This means that the annulus 46 acts as a safety device to prevent overloading since, in the event of such overloading, slippage can occur between the portion 146 and the friction pads 47. The degree of pressure exerted by the springs 48 upon the friction pads 47 and therefore upon the portion 146, and thus the point at which relative slippage can occur, can be adjusted by turning of a tensioning ring 49 which is a part of component 44*b*. The pads 47 can be replaced readily with new ones.

Figure 7:
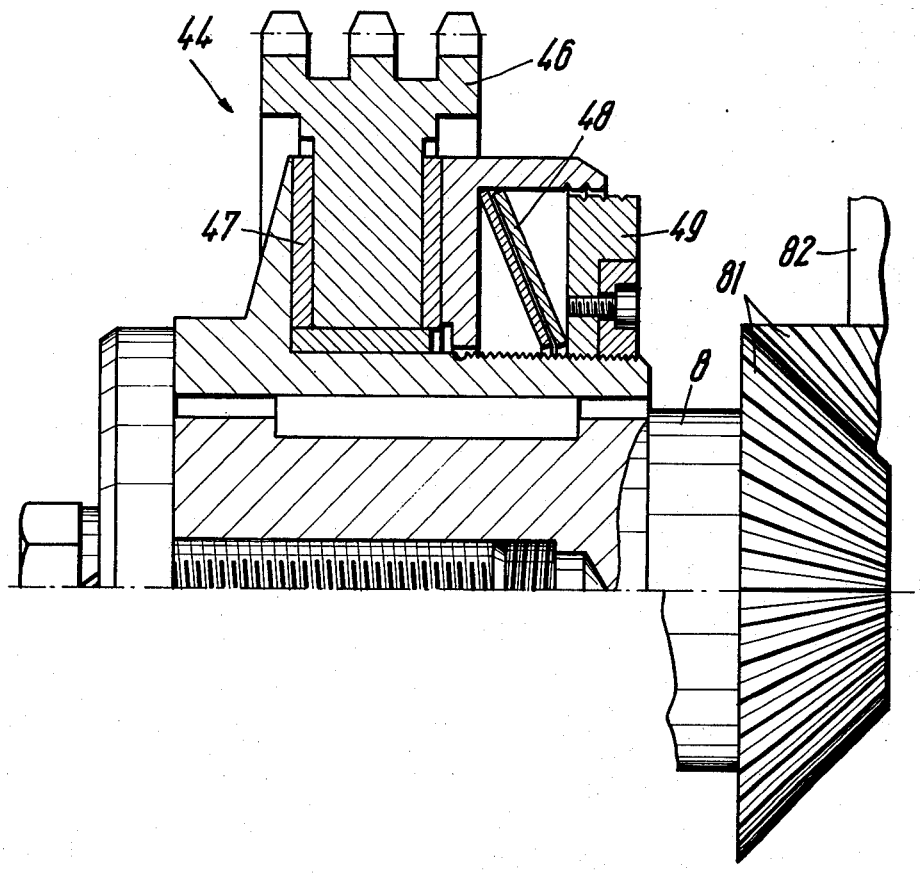
FIG. 7 is a view analogous to FIG. 6, but illustrating a somewhat different embodiment of the slip coupling.

The arrangement in FIG. 6 or alternately the one in FIG. 7, assures that the roller 40 can either be driven directly from the shaft 8 or from the shaft 82. If different carpets 1 having different characteristics or qualities are to be printed in the machine, the slip coupling 44 is readjusted by operation of the ring 49. Its presence assures that the operation of the feed for the carpet or web 1 is dependent upon the tension of the same, and that in dependence upon the particular characteristics of a web an automatic readjustment will take place which obtains a still further improved uniformity of the tension conditions within the web ahead of the printing units 6 than would be possible without the use of the slip coupling 44.

The slip coupling 44 could be replaced with a different type of device performing the same service, for example a hydraulic brake which would be throttled in case of excess pressure.

Returning to FIG. 8 for a further explanation it will be seen that the control motor 197 acts upon a gear ring 297 via a coupling that is illustrated in section. The gearing ring 297 is of the adjustable type known in the art, and its presence means that the motor 197 which has to be controlled as to its rotation, for example by means of a resistor or the like, but that the control can be affected by adjusting the gear ring 297. The gears 198 and 199 were previously discussed with reference to FIG. 3, and the gear 199 transmits via the shaft 192'' the planetary gear carrier 192 which turns about the gears 191 and 193. THe gear 193 is mounted on a sleeve and meshes with a gear 239 which, in turn, meshes with a gear ring 393 which is shown in FIG. 8, but not visible in FIG. 3. The gears 393' and 393'' are turned by the gear ring 393, and in their turn rotate a gear 493 which turns the gear 140 (see also FIG. 3) that rotates the roller 40.

Figure 9:
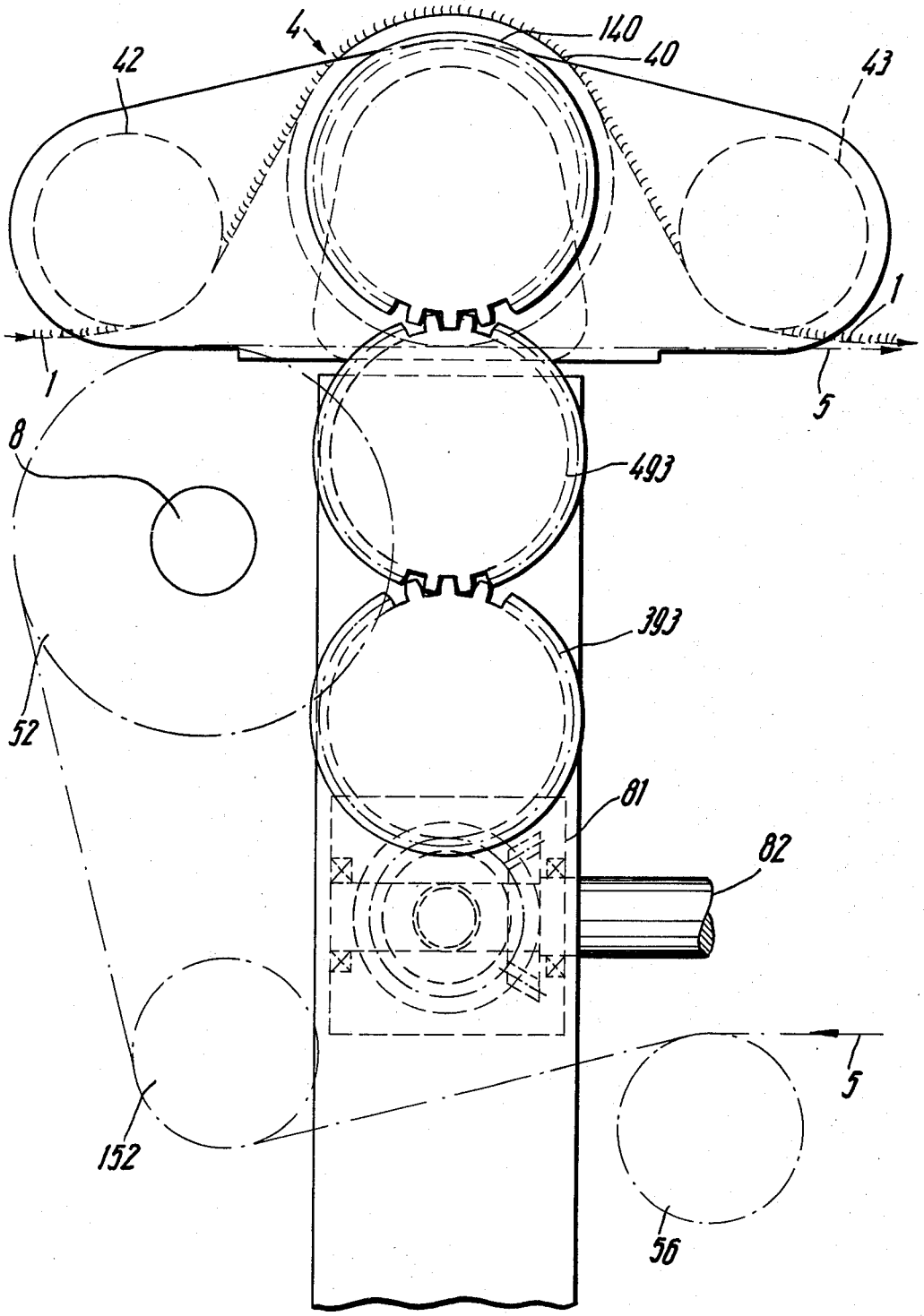
FIG. 9 is a diagrammatic detail view, on an enlarged scale, showing a detail of the feeding arrangement which feeds the web into the machine.

FIG. 9 shows diagrammatically how the drive can be transmitted to the roller 40 and how the various components can be located. It will be seen that the angle drive 81 can also be arranged in the manner from what has heretofore been discussed. The Figure also shows that an additional guide roller 152 for the printing blanket 5 may be provided, if desired.

Figures 10, 11:
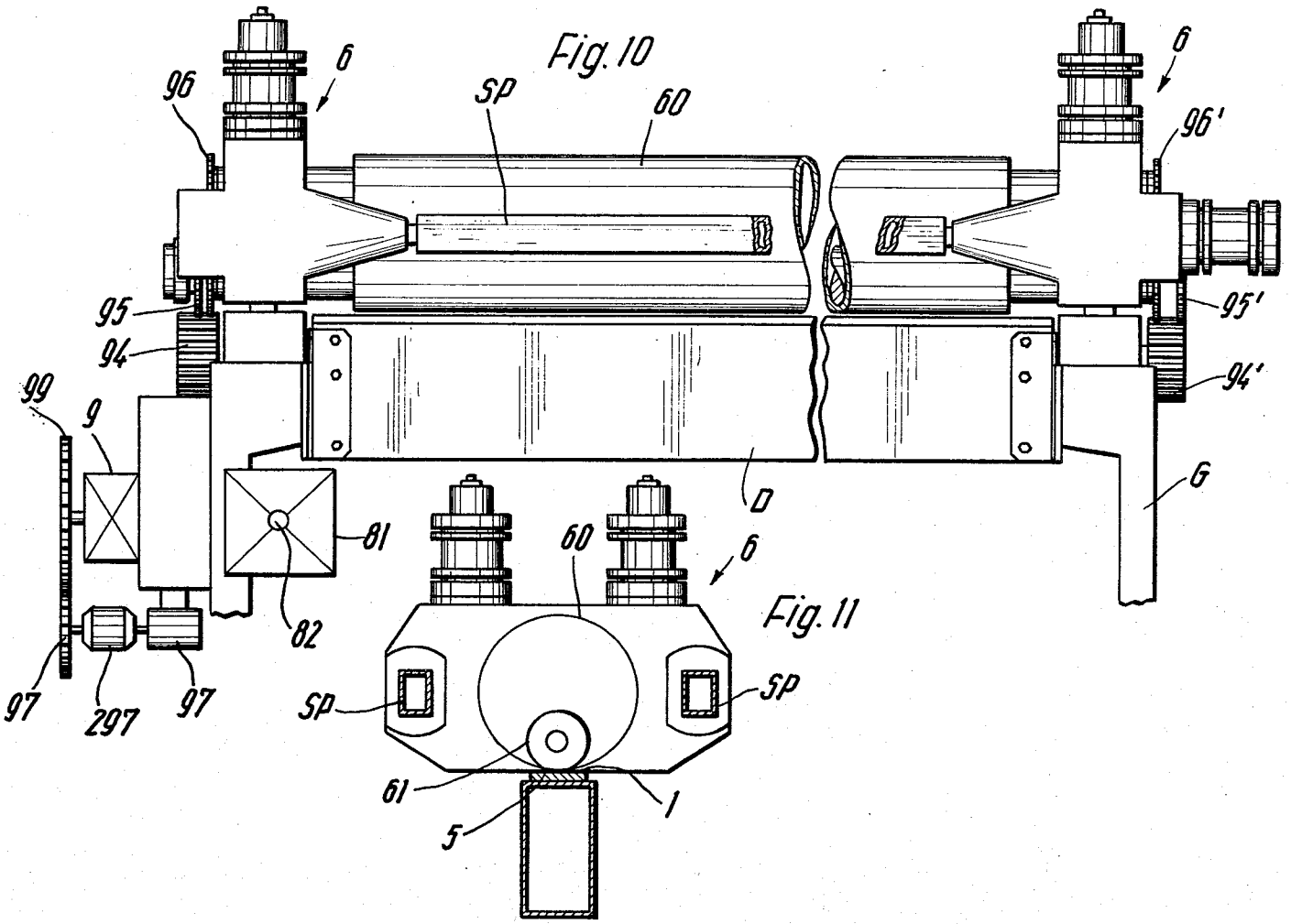
FIG. 10 is a side-elevational view of one of the printing units 6 of the apparatus.
FIG. 11 is an end-elevational view of the printing unit in FIG. 10.

FIGS. 10 and 11 are intended to show more clearly the arrangement of various of the components with reference to the printing screens 60, of which one is illustrated. Reference characters SP illustrate tension members which are located at opposite lateral sides of the printing screen 60 and connect the end mounts thereof in which the printing screen 60 is journalled for rotation. Reference character D identifies a support mounted on the frame G located beneath the printing blanket 5 and the carpet 1, as shown in FIG. 11, so as to provide support in the area where printing takes place.

Figure 12:
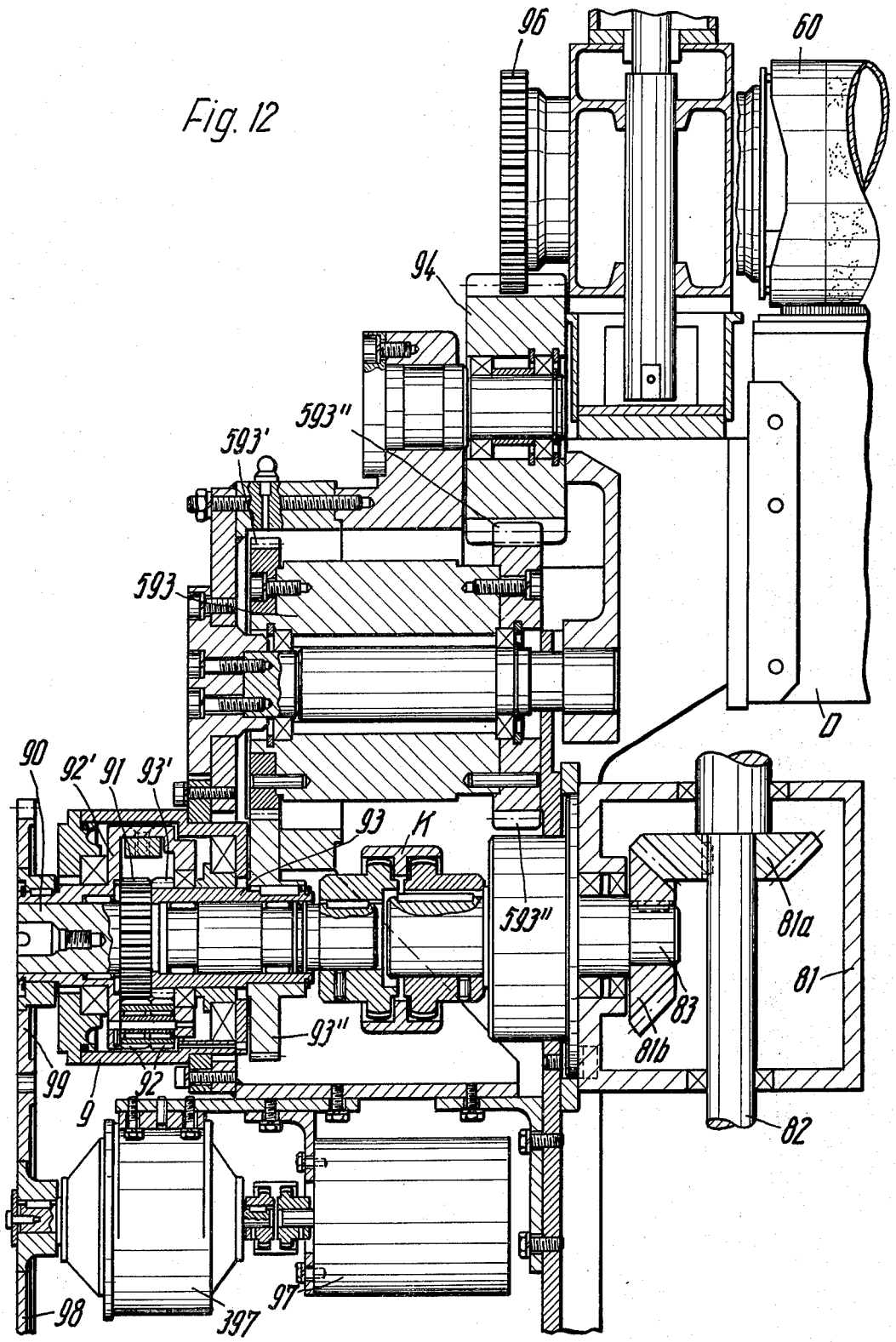
FIG. 12 is a sectioned view showing on an enlarged scale the structural details of the diagrammatically illustrated arrangement in FIG. 2.

The illustration in FIG. 12 has already been discussed, and it remains merely to point out that the control motor 97 here also is not of the type whose operation is controlled directly, but instead that the control motor 97 is coupled as illustrated with a variable gear ring 397. The gear 98 meshes with the gear 99 so that the shaft 90 is turned in rotation. The shaft portion 92' turns the planetary gear carrier 92 which rotates about the gear 91 and the teeth of the gear ring 93. The latter has gears 93' 93'' and transmits motion to a gear ring 593 which has gears 593' and 593''. Gear 593' transmits motion to gear 94 which transmits motion to gear 96 from where the printing screen 60 is driven in rotation. In this embodiment, no squeegee roller has been shown that is intended to be driven by this arrangement, and hence gear 95 is not necessary and has not been illustrated. Also, the gears 84 and 85 shown in FIG. 2 can be omitted in the embodiment of FIG. 12, and replaced with the coupling K, and the components 61, 62 and 95 can also be omitted.

Figure 13:
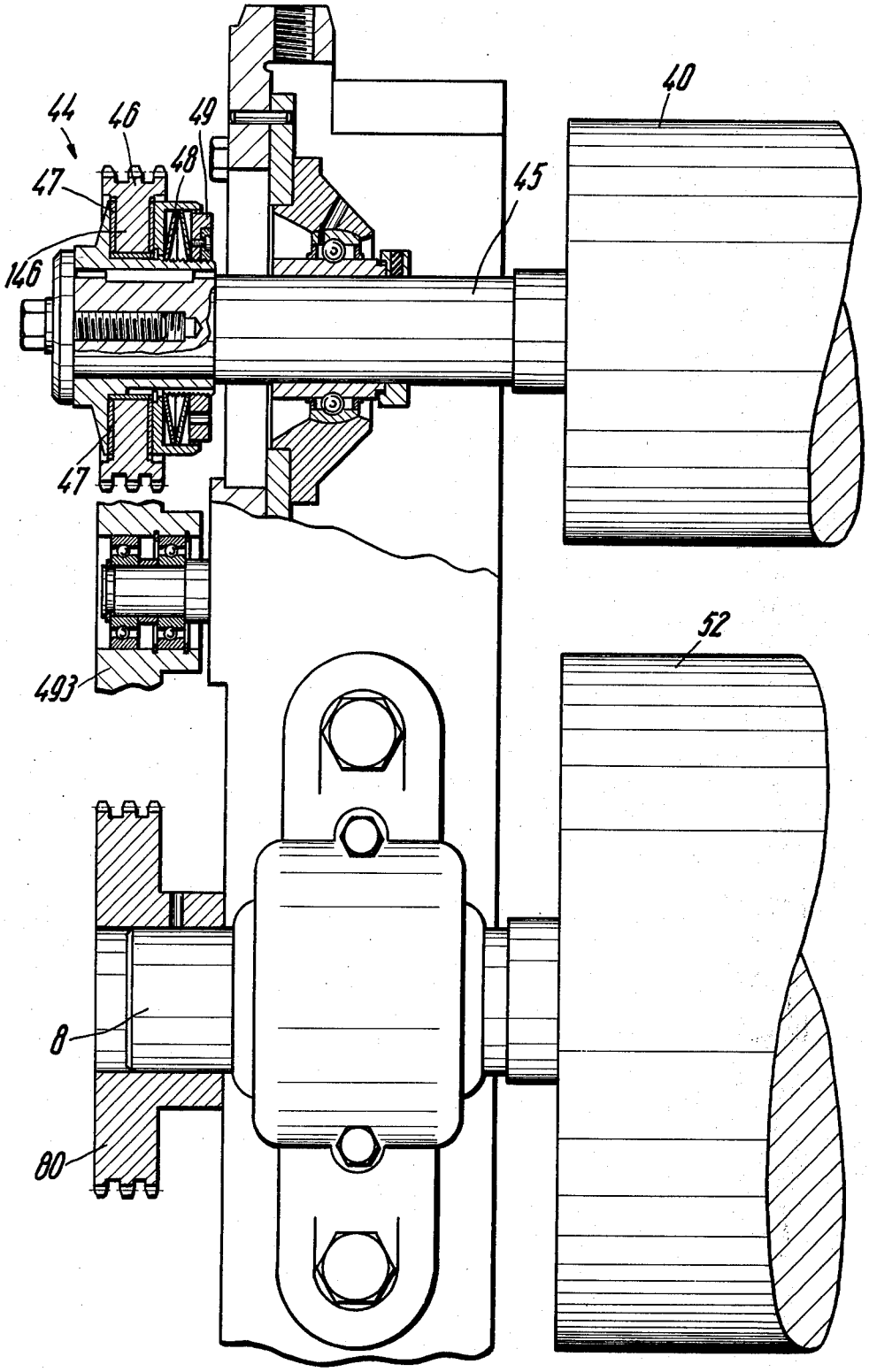
FIG. 13 is a fragmentary partly sectioned detail view illustrating an exemplary embodiment relating to the arrangement of the slip coupling with reference to the feeding roller of the machine.

FIG. 13 shows the arrangement of the slip coupling 44 which in this particular embodiment is arranged in the region of the roller 40, rather than in the region of the shaft 8.

Figure 14:
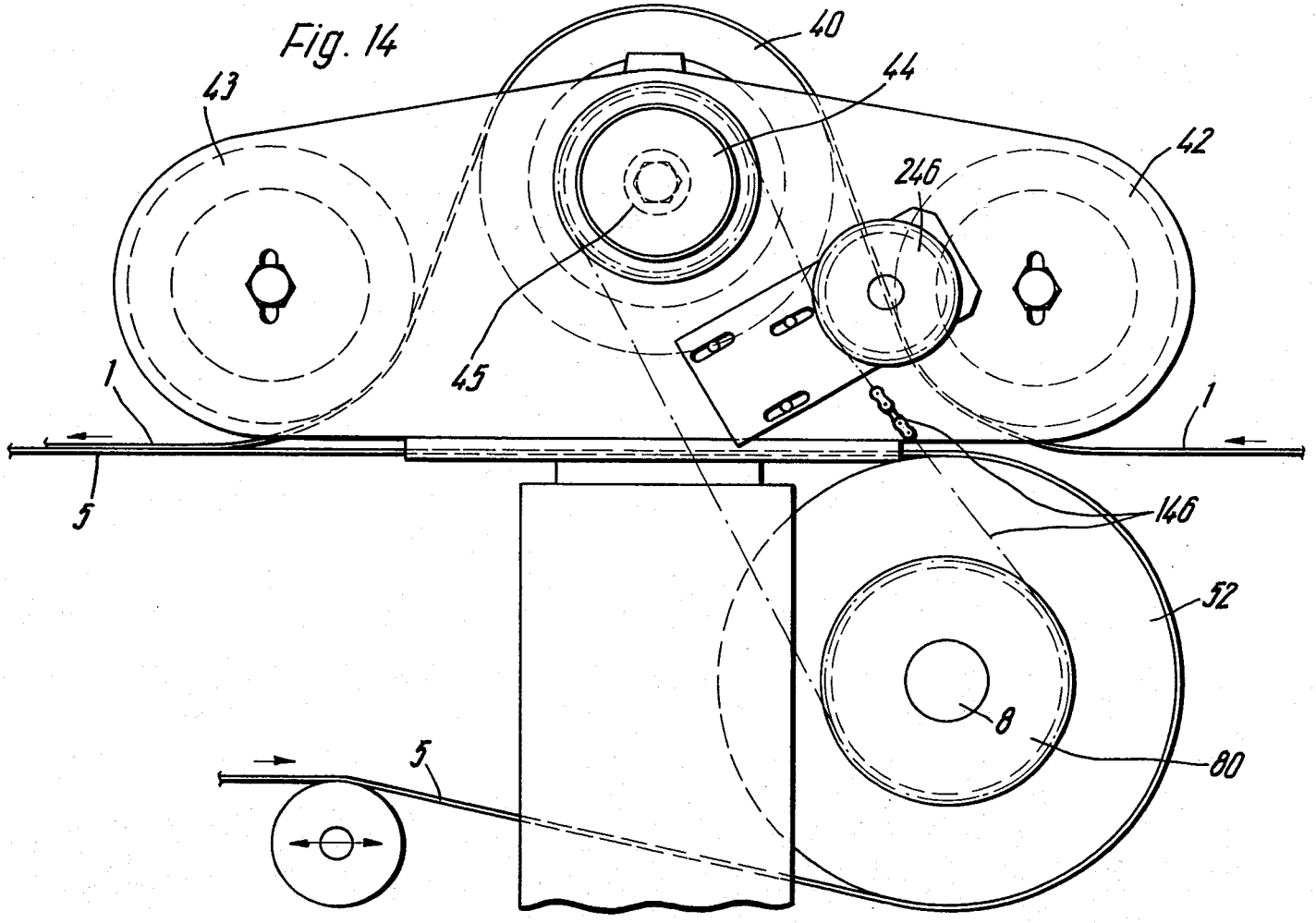
FIGS. 14 and 15 are somewhat diagrammatic detail views illustrating details of the web feeding arrangement of the machine.
Figure 15:
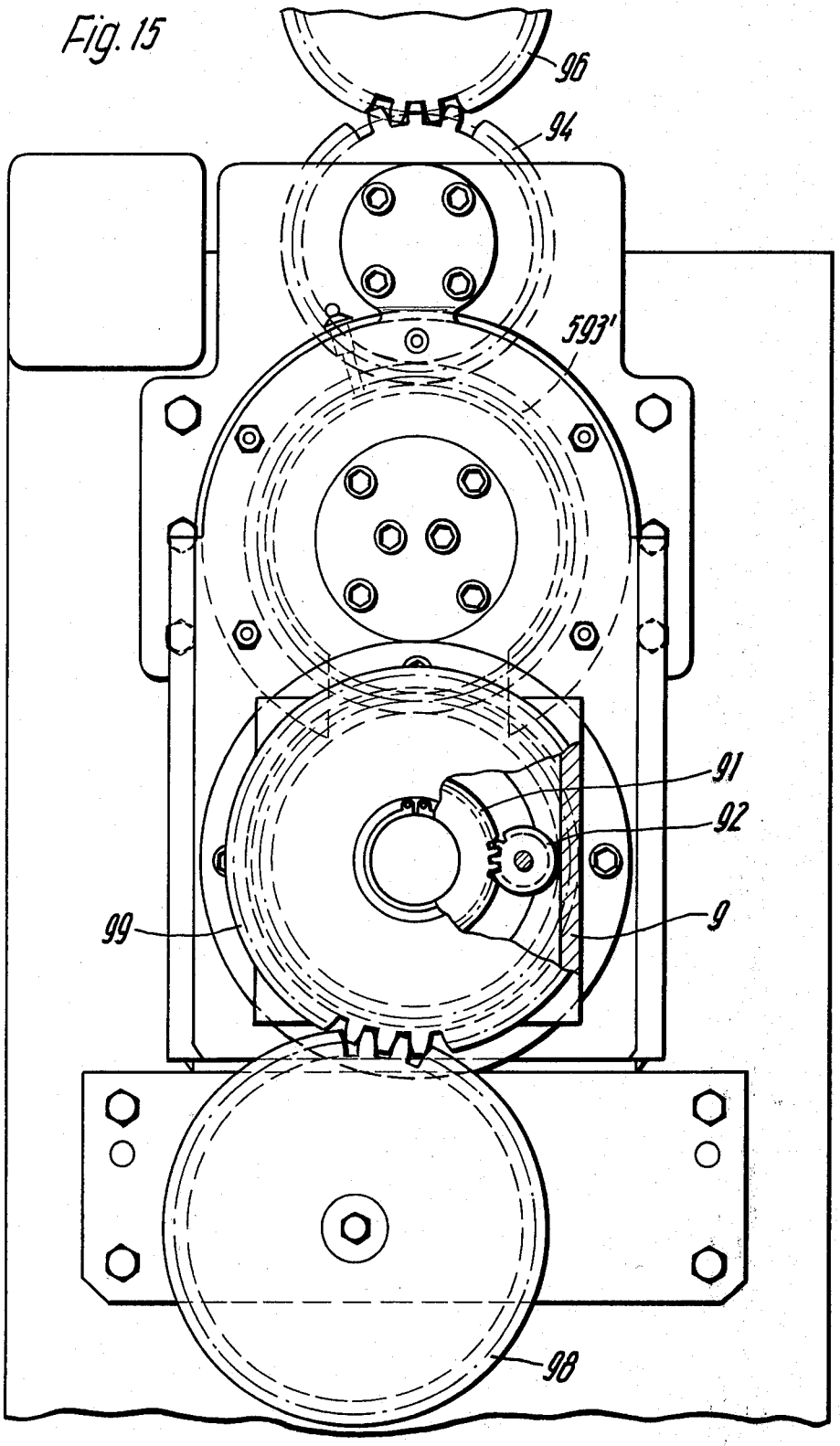

FIGS. 14 and 15 show the feeding device 4 to illustrate that a belt or chain drive, utilizing in this embodiment the chain 146 (compare also FIG. 5) which transmits motion from the roller 52 that is driven from the shaft 8, to the slip coupling 44. Reference numeral 246 identifies a device for tensioning the chain 146 to the desired extent. In this embodiment the direction of travel of the carpet is from right to left (see FIG. 14).

Figure 16:
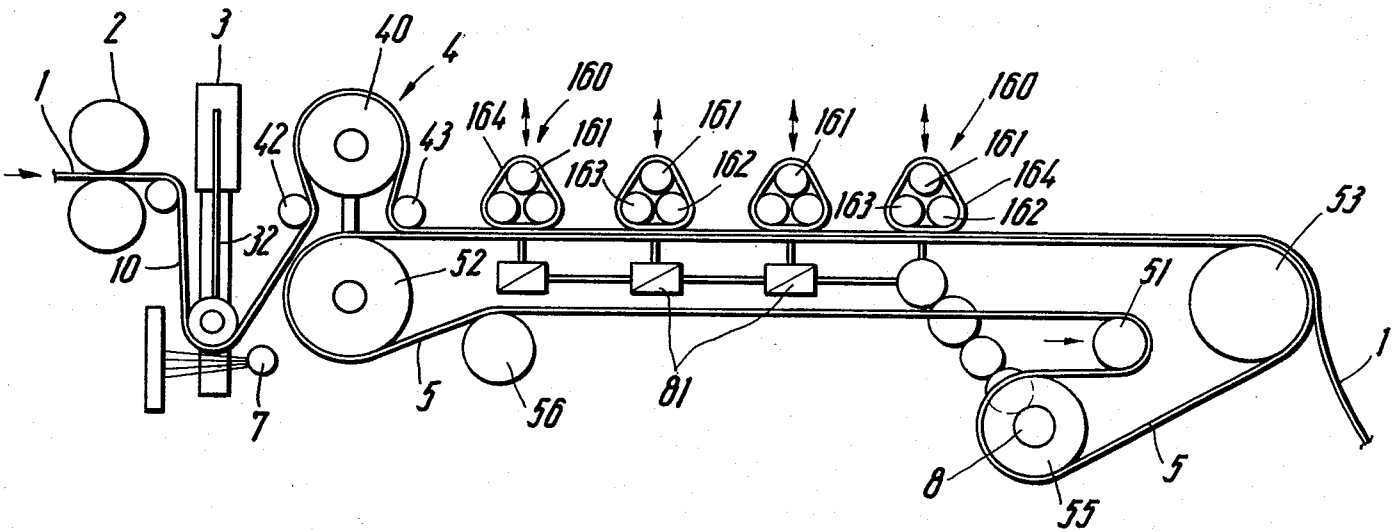
FIG. 16 is analogous to FIG. 1, but illustrates a somewhat different embodiment.

Finally, FIG. 16--which shows the same apparatus as FIG. 1, except that some of the elements of FIG. 1 have been omitted for simplicity--illustrates that the tubular screen printing units 6 can be replaced with others, such as the traveling-band screen printing units 160. These have three axially parallel rollers 161, 162 and 163, about which a flexible band screen 164 is trained which forms a continuous belt. As the double-headed arrows indicate, the units 160 can be raised and lowered. One of the rollers, e.g., the roller 161, is driven and drives the screen 164 by friction, or in another suitable way, e.g., via a sprocket or the like. The printing units 160 are already known per se.

It will be understood that each of the elements described above, or two or more together, may also find a useful application in other types of constructions differing from the type described above.

While the invention has been illustrated and described as embodied in a printing apparatus for printing traveling webs, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims:

1. In a web printing apparatus, a combination comprising a movable printing blanket; first means for advancing said printing blanket at a first speed and in a predetermined direction; second means for advancing said web in said direction at a second speed which is slower than said first speed, including a web feed roller, a drive for rotating said feed roller, and a friction-type slip coupling interposed between said drive and said feed roller and formed with a groove and with an annulus of gear teeth having a portion which extends into said groove; guide means, including a pair of guide rollers extending along the periphery of said feed roller so that the web travels about said periphery intermediate the same and said guide rollers, for guiding said web directly onto said printing blanket and retarding it against acceleration to said first speed, so that the web becomes tensioned due to its frictional engagement with the advancing printing blanket and the differential between said first and second speeds; and printing means for printing onto said web which is supported on said printing blanket.

2. A combination as defined in claim 1, wherein said slip coupling comprises two relatively slidable components one of which is provided with a friction pad, and dished springs located between and bearing upon both of said components.

3. In a web printing apparatus, a combination comprising a movable printing blanket; first advancing means for advancing said printing blanket at a first speed and in a predetermined direction; second advancing means for advancing said web onto said printing blanket at a second speed which is slower than said first speed; combined guide means and means for preventing said web from being accelerated to said first speed by said printing blanket and for guiding said web directly onto the advancing printing blanket to be supported on the same in substantial surface to surface contact so that the web is tensioned due to the slippage caused by the differential between said speeds and the frictional engagement of said web with the printing blanket; and printing means for printing onto said web which is supported on said printing blanket.

4. A combination as defined in claim 3; said second advancing means comprising a feed roller for advancing said web onto said printing blanket; and further comprising a drive unit which is coupled with said first advancing means and said feed roller, and transmission means for transmitting motion from said drive unit to said feed roller.

5. A combination as defined in claim 4, wherein said transmission means comprises an angle drive driven by said drive unit, a planetary gear drive driven by said angle drive, gear transmissions driven by said planetary gear drive, and a control motor for controlling the operation of said planetary gear drive.

6. A combination as defined in claim 3, wherein said printing means comprises a plurality of screen printing units each having a driven printing screen.

7. A combination as defined in claim 6; and further comprising drive means for driving said printing screens at adjustable speeds.

8. A combination as defined in claim 6, wherein said printing units each include a roller squeegee cooperating with the respective printing screen; and further comprising drive means for driving said printing screens and roller squeegee at selectable speeds.

9. A combination as defined in claim 7, said drive means comprising a main machine drive unit, and transmission means for transmitting motion to each of said printing screens, including for each printing screen an angle drive driven by said drive unit, a planetary gear drive driven by said angle drive, a gear transmission driven by said planetary gear drive, and a control motor for said planetary gear drive.

10. A combination as defined in claim 9, wherein each printing screen cooperates with a roller squeegee; and further comprising means for transmitting motion from said drive unit to said roller squeegee.

11. A combination as defined in claim 10, wherein said main drive unit includes a drive shaft; and wherein each of said angle drives is driven by said drive shaft.

12. A combination as defined in claim 11, wherein said first advancing means includes a drive roller for said printing blanket.

13. A combination as defined in claim 3; further comprising feed means for feeding said web towards said second advancing means; and tensioning means upstream of said combined means for tensioning said web.

14. A combination as defined in claim 13; said feed means comprising a pair of nip rollers engaging said web between themselves upstream of said tensioning means.

15. A combination as defined in claim 14, wherein said web forms a loop intermediate said nip rollers and said second advancing means; and wherein said tensioning means comprises a tensioning roller located in said loop and rolling on said web, a cylinder and piston unit, and a piston rod on said cylinder and piston unit and carrying said tensioning roller.

16. A combination as defined in claim 15, wherein the length of said loop tends to fluctuate; and further comprising control means for sensing when the length of said loop exceeds a preset limit, and for varying the operating speeds of said nip rollers and second advancing means to restore the length of said loop to said preset limit.

17. A combination as defined in claim 3, wherein said second advancing means comprises a feed roller; and wherein said combined means comprises a pair of further rollers extending along said feed roller adjacent the periphery thereof, said web traveling about said periphery intermediate the feed roller and the respective further rollers.

18. A combination as defined in claim 17; said second advancing means further comprising a drive for said feed roller.

19. A combination as defined in claim 17; and further comprising a layer of high-friction material on the periphery of said feed roller.

20. A combination as defined in claim 17, wherein said second advancing means comprises a drive for said advancing feed roller including an adjustable slip coupling interposed between said drive and said feed roller.

21. A combination as defined in claim 17, wherein said second advancing means comprises a drive for said feed roller and a slip coupling interposed between said drive and said feed roller.

22. A combination as defined in claim 21, wherein said advancing roller has a mounting shaft; and wherein said slip coupling is provided on said mounting shaft.

23. A combination as defined in claim 21; further comprising a main machine drive unit having a drive shaft; and wherein said drive comprises an angle drive which is driven by said drive shaft and engages said slip coupling.

24. A combination as defined in claim 21, wherein said slip coupling is a friction coupling.

25. A combination as defined in claim 21, wherein said slip coupling is removably mounted so as to be replaceable at will.

* * * * *